US005379927A

United States Patent [19]

Montenieri et al.

[11] Patent Number: 5,379,927

[45] Date of Patent: Jan. 10, 1995

[54] NEW PACKAGE FOR INSTANT ADHESIVES

[75] Inventors: Robert E. Montenieri, Southington, Conn.; Maurice T. O'Connell, Dublin, Ireland; Alan T. Crampton, Dublin, Ireland; Geoffrey F. Seymour, Dublin, Ireland; Richard C. Edstrom, New York, N.Y.; Bryon J. Bourgeois, St. Albans, Vt.

[73] Assignee: Loctite Corporation, Hartford, Conn.

[21] Appl. No.: 209,805

[22] Filed: Mar. 11, 1994

[51] Int. Cl.[6] ..... B65D 47/00

[52] U.S. Cl. ..... 222/546; 222/562; 215/295; 215/321; 215/331; 215/332

[58] Field of Search ..... 222/546, 562, 566; 215/295, 321, 331, 332

[56] References Cited

U.S. PATENT DOCUMENTS

| | | | |
|---|---|---|---|
| 2,665,945 | 1/1954 | Barton | 215/321 X |
| 3,578,224 | 5/1971 | Greenhut | 222/546 |
| 3,828,962 | 8/1974 | Atkins | 215/321 |
| 3,930,599 | 1/1976 | Brothers et al. | 222/562 X |
| 4,413,753 | 11/1983 | Stock | 222/546 X |
| 5,154,327 | 10/1992 | Long | 222/546 X |

FOREIGN PATENT DOCUMENTS

| | | | |
|---|---|---|---|
| 2906818 | 11/1979 | Germany | 222/546 |
| 404525 | 6/1966 | Switzerland | 222/546 |

*Primary Examiner*—Andres Kashnikow
*Assistant Examiner*—Kenneth Bomberg
*Attorney, Agent, or Firm*—Radhika P. Raju; Edward K. Welch, II; Eugene F. Miller

[57] ABSTRACT

A package, with a nozzle, a chamber, a cap which fits over the nozzle, and a pin attached to the interior of the cap which fits into the opening of the nozzle, for storing and dispensing a liquid, having an improved closure mechanism comprising at least one rectangular stopping member and at least one rectangular band in the interior of the cap and at least one guide flange on the nozzle. The package also has a plurality of guide ribs located around the nozzle to aid in the proper placement of the cap. The package is designed to be leak proof, nonclogging, able to dispense the liquid precisely, and can be easily opened even when the pin has bonded to the opening of the nozzle without breaking or shearing the pin.

20 Claims, 7 Drawing Sheets

NEW PACKAGE FOR INSTANT ADHESIVES

BACKGROUND OF THE INVENTION

1. Field Of the Invention

The present invention relates to a new closure mechanism for packages. The invention is especially suited for instant adhesive packages and more particularly, the invention relates to a package for cyanoacrylates.

Cyanoacrylates can bond human skin; therefore, the adhesive package must be designed to prevent leakage. Also, because large surface areas can be bonded with minute quantities of adhesive, the package must be capable of accurately dispensing small quantities to exact locations.

2. Description of the Related Art

Although the invention relates to any package that requires a closure mechanism, the invention will be described in terms of an adhesive package.

Currently, packaging of instant adhesives is done in aluminum tubes, pens and bottles. However, in aluminum tubes, the tip often must be pierced with a pin to open the tube. This necessitates either packaging a separate pin with the tube, or asking the user to find a pin or sharp object with which to open the tube. Typically users squeeze the tube as they are trying to pierce the tip; therefore, when the opening is punctured, unwanted adhesive will squirt out. This often creates a mess and can even be dangerous depending on the type of adhesive contained in the tube. Other disadvantages of tubes include the fact that the pierced tip easily clogs with adhesive that has dried or cured, and that the user is never sure of how much adhesive is left in the container. Pens have spring valves inside their tips which clog easily and also are not capable of directly dispensing in tight locations.

Traditional bottle designs often have leakage problems, and do not accurately dispense adhesive. Also, bottles frequently clog because stray adhesive partially cures around the tip causing the cap to bond to the nozzle. This makes subsequent openings of the bottle difficult. Some bottles have designs where the cap has a built in pin which fits directly into the opening of the bottle similar to the present invention. In these designs the user typically pulls the cap directly up and off the bottle. If the pin bonds to the opening or the cap bonds to the nozzle, due to the buildup of stray adhesive, the pressure applied to pull the cap up and off can cause the pin to break or shear. Also, the user will typically squeeze the bottle while attempting to open it and when the pin disengages from the opening, unwanted adhesive is liable to spurt out. Bottles which employ a threaded cap are especially susceptible to having stray adhesive cause unwanted bonding between the elements of the bottle because the surfaces of the threads provide areas where the adhesive can accumulate. Again, if the threaded cap design employs a built in pin, when the user tries to open a bottle in which the pin has bonded to the opening, the pin will be subject to strong rotational forces that can cause the pin to shear or break.

Therefore, there is a need for an instant adhesive package that does not require a separate pin to open, discourages the bonding of the cap to the nozzle, opens easily without breaking or shearing the pin even if the pin has been bonded to the opening of the bottle or the cap bonded to the nozzle, is non-clogging, protects against leakage, shows how much adhesive is left in the package and allows for precise dispensing of the product.

BRIEF SUMMARY OF THE INVENTION

The present invention provides a closure mechanism for a package which makes the package easy to open and close, leak proof and non-clogging. Also, the package is easy to dispense from, and provides a good shelf life for the product.

Other advantages of the invention will be better appreciated from a detailed description thereof which follows.

DETAILED DESCRIPTION OF THE PREFERRED EMBODIMENTS

Figure 1:
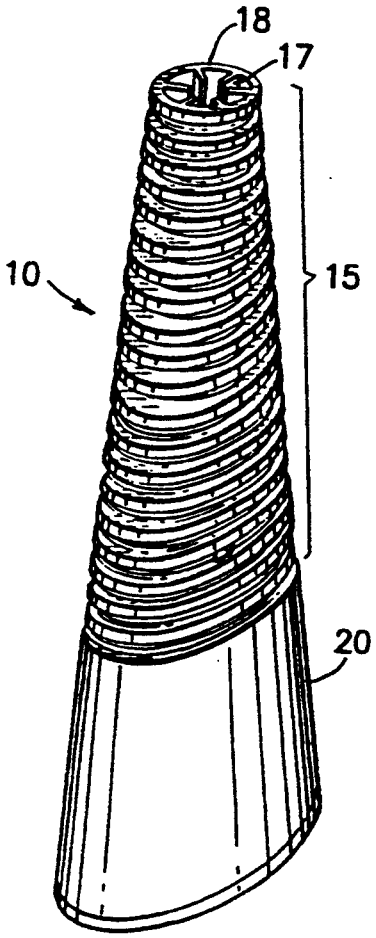
FIG. 1 is a perspective view of a package comprising a body and a cap in accordance with the present invention.
Figure 2:
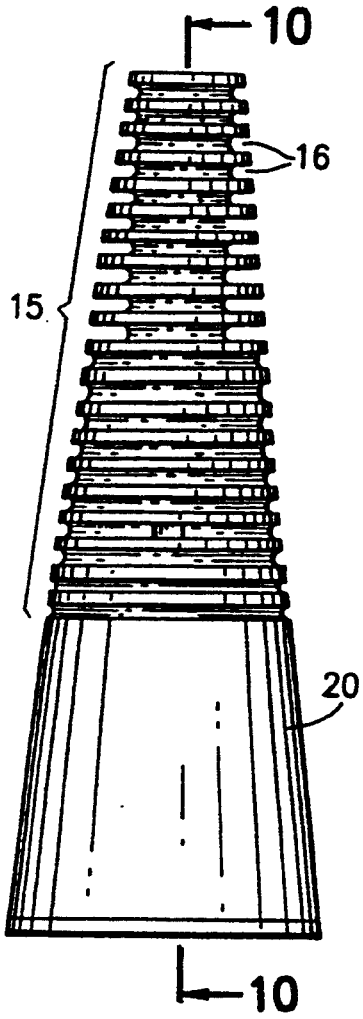
FIG. 2 is an elevational view of the package of FIG. 1.
Figure 3:
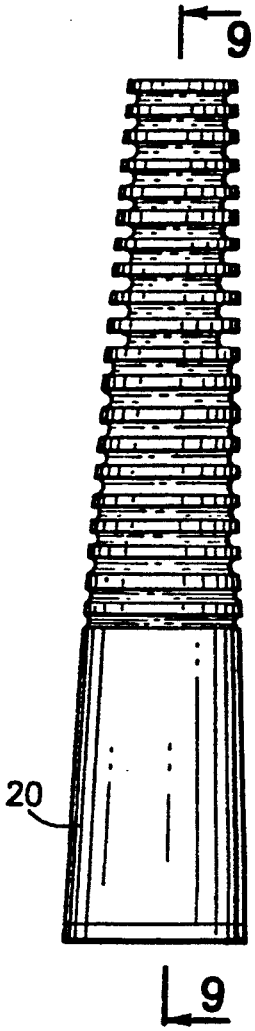
FIG. 3 is an elevational side view of the package of FIG. 1.
Figure 4:
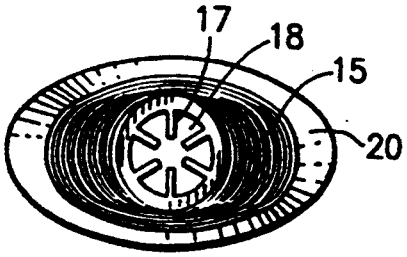
FIG. 4 is a top plan view of the package of FIG. 1.
Figure 5:
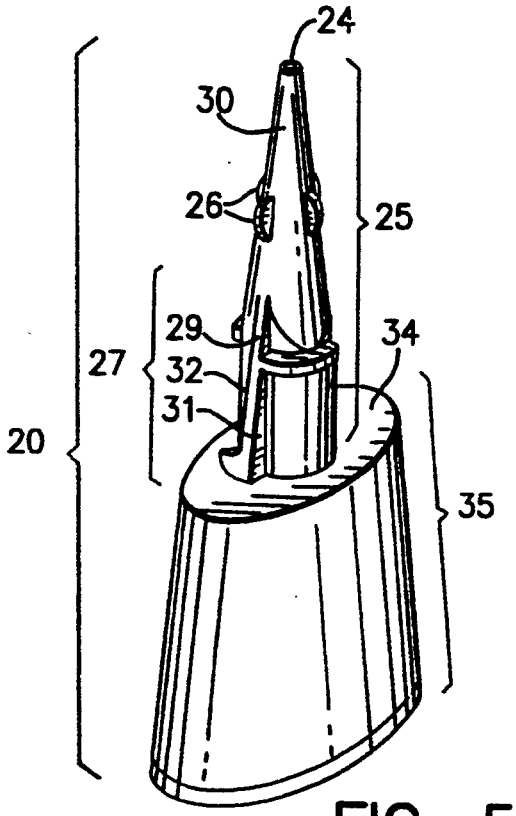
FIG. 5 is a perspective view of the body of FIG. 1.
Figure 6:
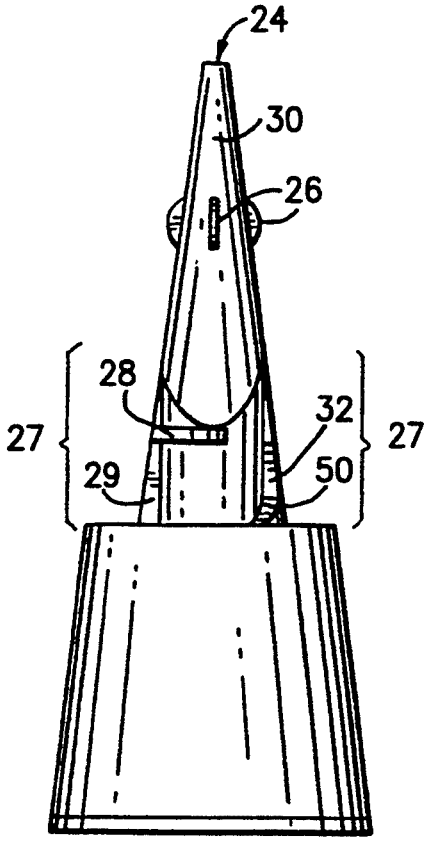
FIG. 6 is an elevational view of the body of FIG. 2.
Figure 7:
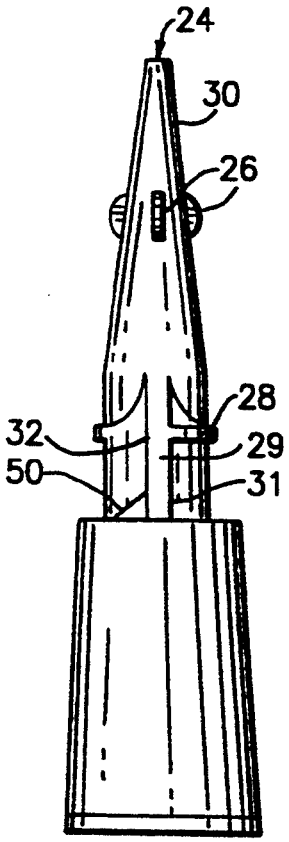
FIG. 7 is an elevational side view of the body of FIG. 3.
Figure 8:
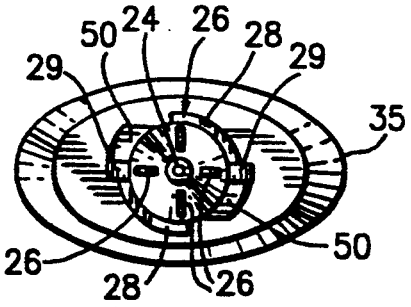
FIG. 8 is a top plan view of the body of FIG. 1.
Figure 14:
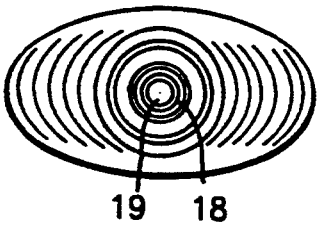
FIG. 14 is a top plan view of a package of FIG. 13.

As shown in FIGS. 1, 2 and 3, the assembled package 10 comprises a cap 15 attached to a body 20. The package 10 can be made of any non-permeable or air permeable material depending on the characteristics of the product in the package. Preferably, for instant adhesives, the package 10 is made from a polyethylene or polypropylene resin. The cap 15 may have a plurality of grooves 16 and preferably the grooves 16 are equidistantly spaced and cover the entire length of the cap 15. The grooves 16 make the package 10 easier to grip and, therefore, easier to open and close. As shown in FIG. 4, the top of the cap 15 may have a molded in design. FIGS. 1 and 4 illustrate one possible design that consists of radially spaced blades 17 in a cylindrical recess 18. FIG. 14 illustrates another design that consists of a cylindrical recess 18 which contains in the center, a raised circular nub 19.

As shown in FIGS. 5, 6, 7 and 8, the body 20 comprises at the upper end a tapered nozzle 25 where the adhesive is dispensed and at the lower end a chamber 35, having a top surface 34, where the adhesive is stored. The design of the nozzle 25 ensures good drain back of adhesive, when the package 10 is in an upright position. Therefore, the chances of adhesive remaining in the upper portion of the nozzle 25, crusting and eventually clogging the opening of the package is decreased. The nozzle 25 has a tip 30 with an orifice 24, and two superstructures: guide ribs 26 and a pair of guide flanges 27. A plurality of guide ribs 26 may be employed but, preferably, there are four equidistantly spaced ribs 26 parallel to the axis of the body. The ribs 26 aid in the proper placement of the cap 15 over the nozzle 25 and, at the same time, allow for a package design that has less surface contact between the nozzle 25 and the cap 15. This decreases the chances of having any stray adhesive that might have dripped down the outside of the nozzle 25 bonding the nozzle 25 to the cap 15.

The guide flanges 27 are located below the ribs 26, at the base of the nozzle 25. Each guide flange 27 has a horizontal lock member 28 and a vertical guide member 29 which is perpendicular to the horizontal lock member 28. The vertical guide member 29 has at its lower extremity a raised ramp portion 50 and also a guide surface 32, facing away from the horizontal lock member 28 and a stop surface 31, facing the horizontal lock member 28. The guide surface 32 is defined by the raised ramp portion 50 and the adjoining face of the vertical guide member 29. The stop surface 31 is defined by the opposite face of the vertical guide member 29. It is preferred to have two guide flanges 27 on the nozzle 25 spaced equidistantly on opposite sides of the nozzle 25.

Figure 9:
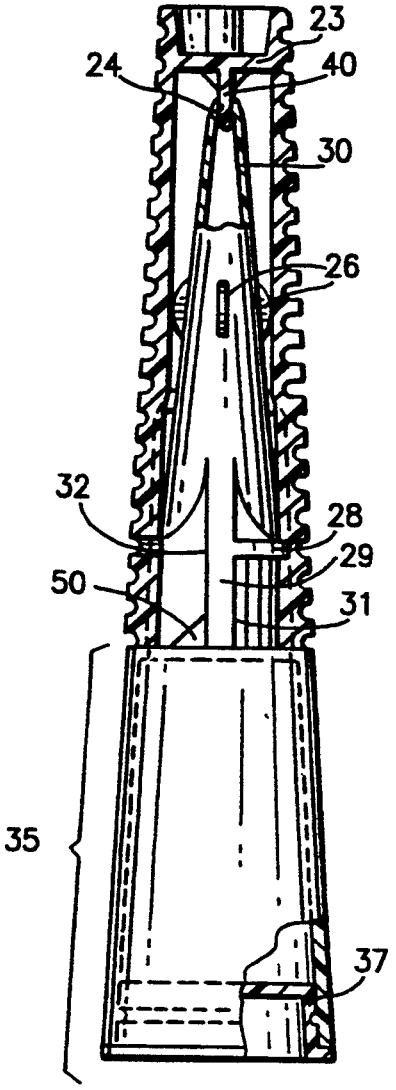
FIG. 9 is a partial cross-sectional view of the package of FIG. 3 taken along the line 9—9.
Figure 10:
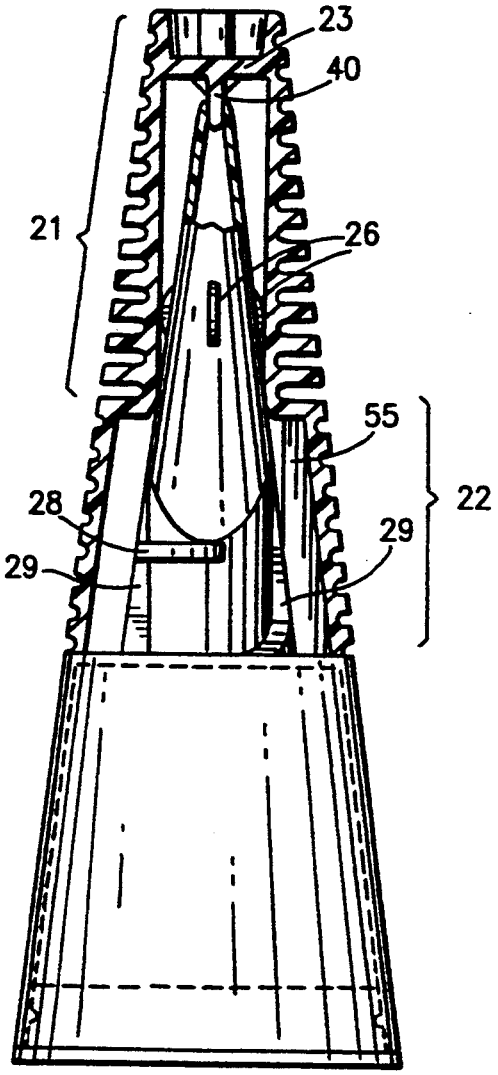
FIG. 10 is a partial cross-sectional view of the package of FIG. 2 taken along the line 10—10.
Figure 22:
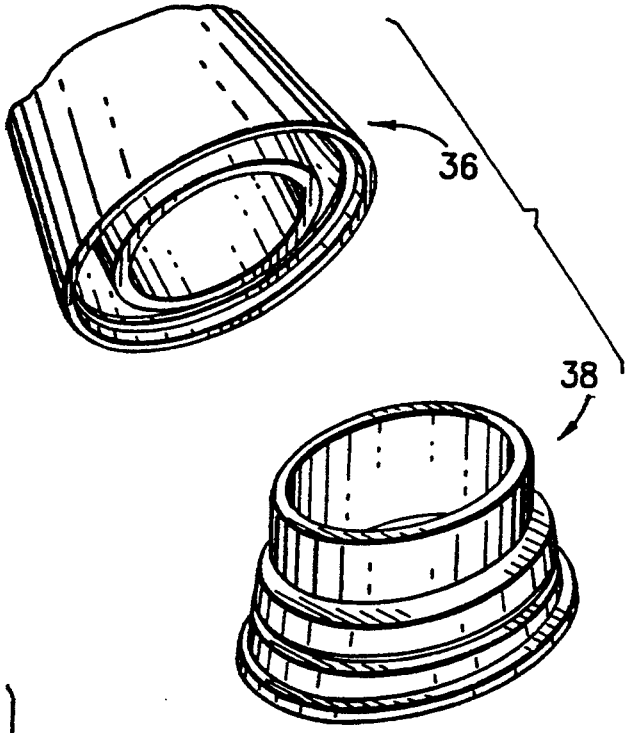
FIG. 22 is a partial elevational view of the disassembled body of FIG. 21.

As can be seen from FIGS. 9 and 10, the cap 15 fits over the nozzle 25 and rests on top of the chamber 35. The exterior shape of the cap 15 mimics the shape of the nozzle 25, having a narrower top and broadening as it reaches the chamber 35. The break away portion of FIG. 9 illustrates a plug 37 which comprises the bottom of the chamber 35. The plug 37 is designed to be snug-fitting and to prevent leakage. The body 20 may be a unibody, meaning it may be molded in one piece or a multibody as shown in FIG. 22 where the plug 38 and the body 20 are molded separately and then attached.

The cap 15 has a structured, mainly hollow interior. The upper portion 21 of the interior of the cap 15 is preferably a cylindrical recess. The diameter of the upper portion 21 should be slightly larger than the diameter of the ribs 26 at their widest point, so that the cap 15 has a snug, non-interference fit with the guide ribs 26 of the nozzle 25. This is one part of ensuring that the cap 15 is tight fitting. The lower portion 22 of the cap 15 is preferably a tapered elliptical recess that follows the taper of the lower portion of the nozzle 25. The interior uppermost surface 23 of the cap 15 contains a pin 40 which protrudes from the uppermost surface 23 into the cylindrical recess of the upper portion 21 of the interior of the cap 15 and the pin 40 is oriented along the central axis of the package 10. The pin 40 is designed to fit snugly into the orifice 24 of the dispensing tip 30. The pin 40 keeps the adhesive from leaking out of the top of the package 10 when the package 10 is placed in a non-upright position. Also, the pin 40 serves a nonclogging function. When the cap 15 is on the body 20, the pin 40 is ensconced in the orifice 24 which discourages adhesive buildup at the tip 30 and each time the cap 15 is placed back on the body 20, the pin 40 will pierce through any adhesive that might have crusted in and around the orifice 24.

Figure 13:
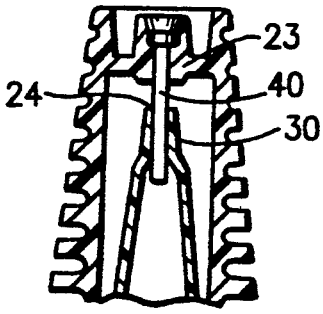
FIG. 13 is a partial cross-sectional view of the upper portion of a second embodiment of the present invention.

The pin 40 can be made of any rigid material. Preferably, the pin 40 is made of either plastic or metal. If desired, the design on top of the cap 15 can be varied to indicate what material the pin 40 is made of. For example, the design defined by structures 17 and 18 on top of the cap 15 shown in FIG. 4 could indicate that a plastic pin was being used and the design defined by the structures 18 and 19 shown in FIG. 14 could indicate that a metal pin was being used. The pin 40 can be molded in as a component of the cap 15 as shown in FIGS. 9 and 10 which employ a plastic pin 40, or overmolded or attached after molding as shown in FIG. 13 which employs a metal pin 40.

Figure 11:
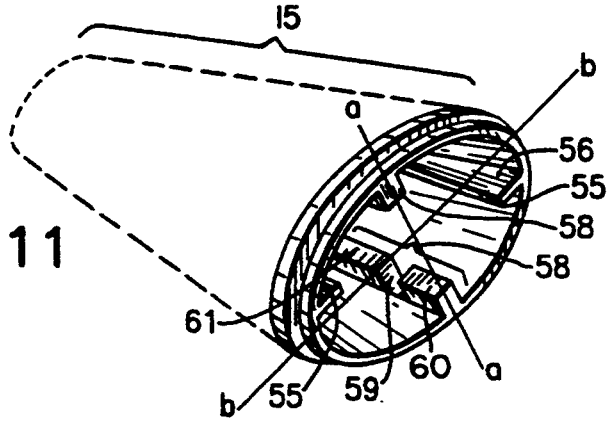
FIG. 11 is a partial perspective view of the interior of the cap of FIG. 1.
Figure 17:
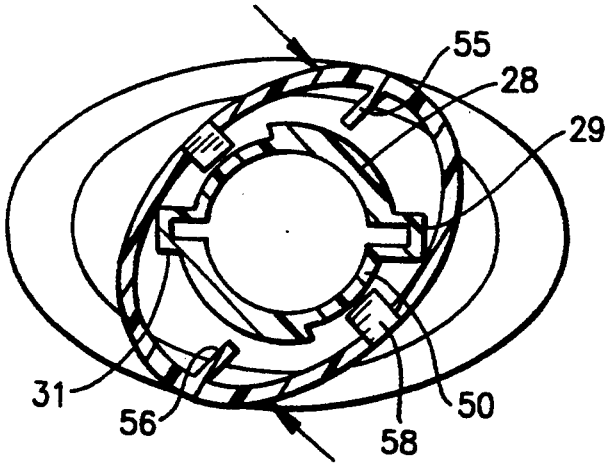
FIG. 17 is a cross-sectional view along the line 17—17 in FIG. 15 with the cap rotated about 45 degrees about the axis.

As shown in FIG. 11, the interim of the cap 15 contains two stopping members 55 and two band members 58. If the bottom of the cap 15 is viewed as an ellipse, the band members 58 are located at opposite ends of the minor axis (line a,a in FIG. 11) and extend throughout the lower portion 22 of the cap 15, parallel to the axis of the cap 15. Each band member 58 has a slot 59 which has a width similar to the width of the horizontal lock member 28. The slot 59 divides the band member 58 into an upper portion 61 and a lower portion 60. The lower portion 60 is directly below the slot 59 extending from the bottom of the slot 59 to the bottom of the cap 15. The slot 59 is located at the same height as the horizontal lock member 28 is, when the cap 15 is on the body 20.

Each stopping member 55 also extends parallel to the axis of the cap 15 throughout the lower portion 22 of the cap 15. Each stopping member 55 has a vertical edge 56 which extends along the entire length of the stopping member 55. The stopping members 55 are located at opposite ends, one stopping member 55 is slightly above the major axis (line b,b in FIG. 11) and the other stopping member 55 is slightly below the major axis, such that when the cap 15 is fully closed on the body 20, the two vertical edges 56 of the stopping members 55 abut the two stop surfaces 31 of both vertical guide members 29. To achieve this configuration, the distance from the axis of the body 20 to the vertical edges 56 of the stopping members 55 must be greater in length than the distance from the axis of the body 20 to the outermost surface of the horizontal lock members 28.

Figure 12:
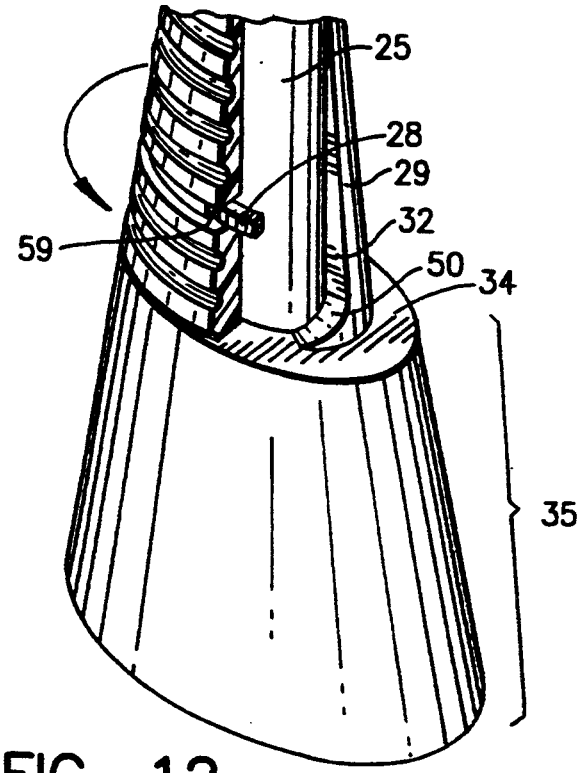
FIG. 12 is a partial cross-sectional view of the package of FIG. 1.

As can be seen from FIG. 12, to open the package 10, the cap 15 must be twisted about the axis of the body 20 generally no more than 30°-60° . This twisting action slides the band member 58 along the horizontal lock member 28 of one guide flange 27 towards the guide surface 32 of the vertical guide member 29 of the other guide flange 27 and effectively retracts the horizontal lock members 28 from the slots 59 of band members 58. As the band members 58 approach the guide surfaces 32 of the vertical guide members 29, the lower portion 60 of band members 58 hit the raised ramps 50 and start to ride up the vertical guide members 29. This provides a structural lift which automatically raises the cap 15 up slightly and also gently twists and lifts the pin 40 out of the orifice 24 of the nozzle 25. This is known as the ramping feature of the present invention. Then the cap 15 can be easily pulled directly up and off the nozzle 25. The stopping members 55, band members 58 and the guide flanges 27 make up the closure mechanism of the present invention.

As discussed previously, preferably the pin 40 can be made of either metal or plastic. Metal is often employed because it will provide a more rigid structure than plastic will. However, metal does have disadvantages, for instance it is more expensive than plastic. In addition, it takes more time to manufacture a package with a metal pin because one either has to overmold the metal pin or attach it after the molding is finished as opposed to a plastic pin which can be molded in with the rest of the package. Also, sometimes the contents of the package might react undesirably with metal; e.g. certain adhesives are known to polymerize in the presence of metal ion.

Whatever type of pin 40 is employed, the ramping feature will minimize the shearing forces that act upon the pin 40 when the package is opened. The ramping feature is particularly useful in packages where the contents have some degree of adhesiveness and there is a chance that the pin 40 might adhere to the orifice 24 or the cap 15 adhere to the nozzle 25. In these instances, depending upon the adhesive strength of the contents, considerable force might be needed to dislodge the pin 40 or cap 15. As the cap 15 is twisted,, the pin 40 turns in the orifice 24 and is retracted from the orifice 24 at relatively the same time. In other words, the pressure required to open the package 10 is divided between the force applied in the axial direction and the force applied around the axis of the package 10. This prevents too much force being applied in one direction, which can cause excessive shearing or even breakage of the pin.

In contrast, in quick pull packages (packages where the user simply pulls the cap straight up) which employ a pin in the cap, the cap would be lifted directly up and off the nozzle, creating a strong unidirectional force along the axis of the package. In situations where the pin is bonded to the orifice, this type of force can shear or break the pin. Threaded top bottles which employ a pin in the cap, require the user to exert strong rotational forces with only minimal axial forces to open the bottle. The user has to apply enough pressure around the axis of the bottle to rotate the cap at least one turn (360°) and more typically one and a half turns (540°) before any upward force is exerted on the cap. Again, in the inadvertent and unwanted bonding situation described above, when the user attempts to open the bottle, the strong rotational force could shear or break the pin.

It has been found for packages of the present invention which hold cyanoacrylate adhesive, that a metal pin is probably necessary, even though the ramping feature will minimize the shearing forces, because of the high adherence strength of the cyanoacrylate adhesive and the concomitant force required to dislodge a pin 40 which has bonded to the orifice 24 due to stray adhesive. The type of pin 40 to be employed in package 10 therefore depends upon the contents of package 10. One skilled in the art can determine through simple experimentation what type of pin 40 should be used.

Figure 15:
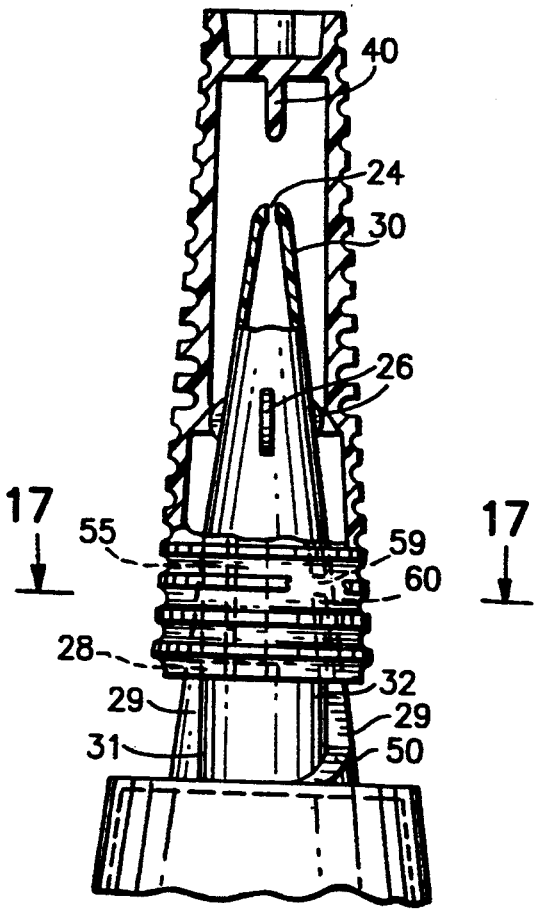
FIG. 15 is a cross-sectional view of the package of FIG. 1 in a partially disassembled state.
Figure 16:
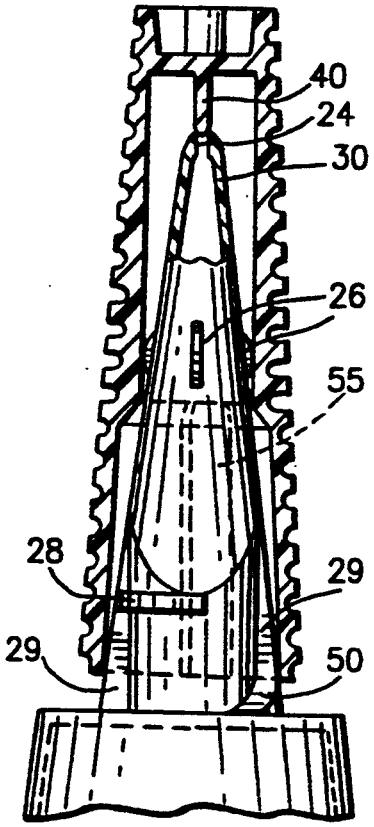
FIG. 16 is a cross-sectional view of the package of FIG. 1 in a partially disassembled state.

To close the package 10, the cap 15 is placed on the nozzle 25 so that the lower portion 60 of the band members 58 pass between the horizontal lock member 28 of one guide flange 27 and the vertical guide member 29 of the other guide flange 27. The cap 15 is then pushed down until the lower portion of the bands 60 meet the raised ramps 50 on the guide surfaces 32 of the vertical members 29. FIG. 15 illustrates the moment in time when the cap 15 is placed on the nozzle 25 and the guide ribs 26 first make contact with the interior surface of the upper portion 21 of the cap 15. The ribs 26 ensure the proper alignment of the cap 15 on the nozzle 25 so that the pin 40 fits directly into the orifice 24 of the nozzle 25 as shown in FIG. 16. Once the lower portion of the bands 60 touch the ramps 50, the cap 15 must be twisted along the axis of the body 20 to line up the bottom of the cap 15 with the top of the chamber 35. As the cap 15 is twisted into place, three things will happen. First, the pin 40 will penetrate the orifice 24 of the nozzle 25. Second, the horizontal lock members 28 of the guide flanges 29 will engage the slots 59 of the band members 58, locking the cap 15 onto the body 20 and third, the vertical edge 56 of both stopping members 55 will hit the stop surface 31 of both vertical guide members 29 preventing the cap 15 from over rotating or twisting any further.

The engagement of the slots 59 by the horizontal locking members 28 prevents a user from pulling the cap 15 straight off the nozzle 25 and subjecting the pin 40 to shearing forces. Instead, the cap 15 must first be twisted so that the horizontal locking member 28 is retracted off the slot 59, and the pin 40 is twisted in the orifice 24, before any upward pressure can be placed on the cap 15. The package design also prevents the cap 15 from inadvertently falling off the body 20.

Figure 18:
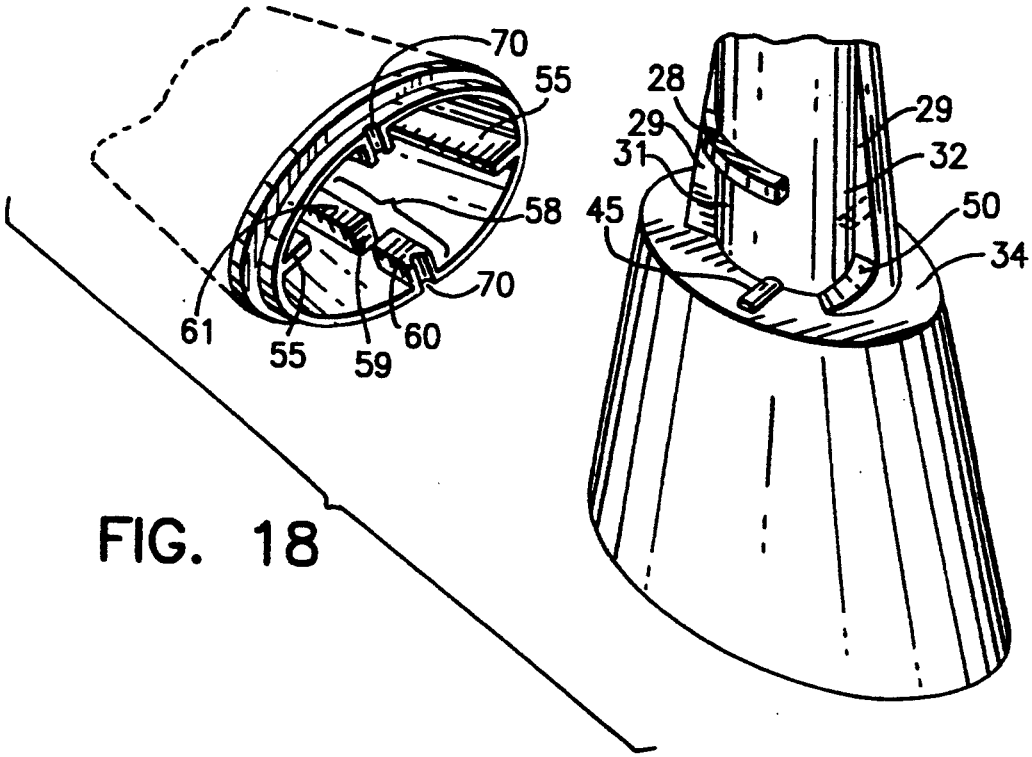
FIG. 18 is partial perspective view of the disassembled package showing a third embodiment of the present invention.
Figure 19:
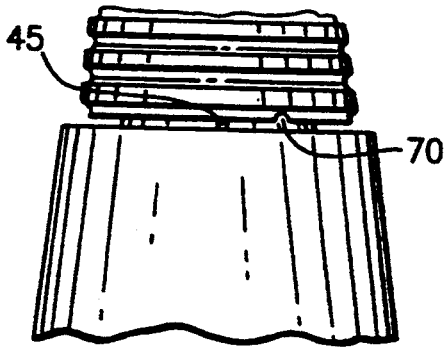
FIG. 19 is a partial view of the package of FIG. 18 where the cap is not fully closed on the body.
Figure 20:
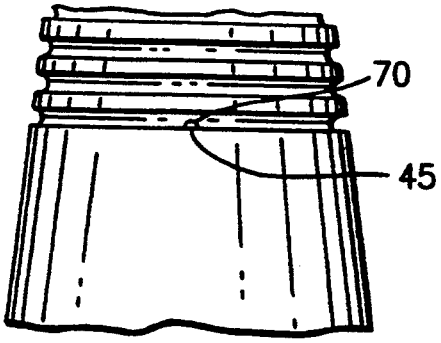
FIG. 20 is a partial view of the package of FIG. 18 where the cap is fully closed on the body.

In an alternate embodiment of the invention as shown in FIGS. 18, 19, and 20, the top surface 34 of the chamber 35 may contain a plurality of retaining nibs 45 and an equal number of hollows 70 on the base of the cap 15. Preferably, there are two retaining nibs 45 positioned on opposite sides of the nozzle 25 on the top surface 34 of the chamber 35 and two corresponding hollows 70 on the cap 15. As the cap 15 is twisted back on to the body 20, the retaining nibs 45 are engaged by the hollows 70 providing a snap fit between the bottom of the cap 15 and the top surface 34 of the chamber 35. The hollows 70 and retaining nibs 45 are additional preferable components of the closure mechanism of the present invention.

Figure 21:
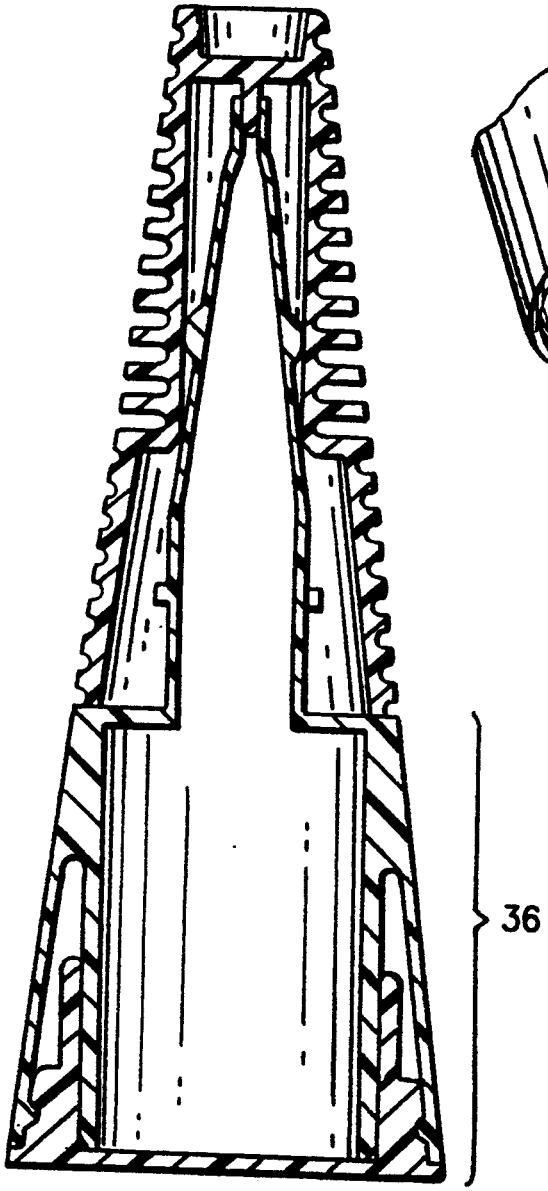
FIG. 21 is a cross-sectional view of a fourth embodiment of the present invention.

Another embodiment of the present invention provides a dual walled chamber 36 as shown in FIG. 21. FIG. 22 illustrates a plug 38 designed for the dual walled chamber. This dual wall feature has several advantages. First, it provides more sealing surface between the body 20 and the plug 38. This helps to ensure a tight fitting bottom for the body 20 and thus decreases the chances of a leak. Secondly, the dual wall 36 provides an additional barrier between the ambient air and the contents of the package 10. This is important when the ambient conditions are such that they will adversely affect the contents of the package 10, for example when the air contains a lot of moisture and the package 10 contains adhesive. Also, the dual wall design gives the chamber 36 of the package 10, more flexibility so that less pressure needs to be applied to dispense from the package 10.

Obviously, other modifications and variations to the present invention are possible and may be apparent to those skilled in the art in light of the above teachings. For example, this invention may be applied to containers and container closures having a circular, as opposed to an elliptical, cross-section. In such instances, the orientation of the guide flanges, rectangular bands, and rectangular stopping members may be different. For instance, a circular cross-section would allow for a greater turning radius between full closure and opening. However, the turning radius would still be less than 180° and preferably less than about 90°. Obviously, the turning radius would also depend upon the number of guide flanges, band members, and stopping members to be employed since the maximum turning radius decreases with the larger number of such features. Another alternative may be where the band member and the stopping member are one rather than two separate elements. Thus, it is to be understood that such modifications and variations to the specific embodiments set forth above, are to be construed as being within the full intended scope of the present invention as defined by the appended claims.

We claim:

1. A package, for storing and dispensing liquids, of the type in which a body comprising a nozzle with an orifice, and a chamber having a top surface from which the nozzle extends, has a cap which fits snugly over the nozzle, the cap also having an interior pin which fits into the orifice of the nozzle, keeping the nozzle from clogging, the improvement being a closure mechanism comprising:

(a) at least one guide flange located at a base of the nozzle, the flange further comprising a horizontal lock member and a vertical guide member, the vertical guide member perpendicular to the horizontal lock member, the vertical guide member having a lower raised ramp member, a guile surface defined by the raised ramp member and an adjoining face of the vertical guide member, and a stop surface defined by an opposite face of the vertical guide member;

(b) the cap having a lower portion with a first recess and an upper portion with a second recess, the first recess having a larger diameter than the second recess;

(c) at least one stopping member in the lower portion of an interior of the cap, the stopping member extending throughout the lower portion, parallel to an axis of the body, further comprising a parallel vertical edge which extends along the entire length of the stopping member, the stopping member located in a configuration such that when the cap is placed in a fully closed position on the body, the vertical edge abuts the stop surface of the vertical guide member preventing the cap from over rotating on the body; and (d) at least one band member in the lower portion of the interior of the cap, the band extending throughout the lower portion of the cap, parallel to the axis of the body, the band member further comprising a slot dividing the band member into an upper portion and a lower portion, the slot located at about the same height as the horizontal lock member when the cap is placed in a fully closed position on the body and the slot having a width slightly larger than the width of the horizontal member of the guide flange such that when the cap is placed in the fully closed position, the horizontal lock member extends through the slot, the lower portion of the band member extending from an end of the slot to a bottom of the cap;

such that to open the package, the cap is twisted about the axis of the package, retracting the horizontal locking member from the slot, until the lower portion of the band member touches and travels up the ramp member and the guide surface of the vertical guide member, disengaging the pin from the orifice and causing the removal of the cap from the body.

2. The package of claim 1 wherein the lower portion of the cap and the top surface of the chamber have an elliptical cross section with a major and minor axis, the band member located on the minor axis and the stopping member located around the major axis in a configuration such theft when the cap is placed in a fully closed position on the body, the vertical edge of the stopping member abuts the stop surface of the vertical guide member.

3. The package of claim 1 wherein the package contains a curable material.

4. The package of claim 3 wherein the curable material is an adhesive.

5. The package of claim 1 wherein the closure mechanism further comprises two equidistantly spaced retaining nibs on opposite sides of the top surface of the chamber and two corresponding hollows in a base of the cap, such that when the cap is placed in the fully closed position on the body, the hollows engage the retaining nibs.

6. The package of claim 1 wherein the nozzle further comprises a plurality of guide ribs equidistantly spaced around the nozzle, parallel to the axis of the package and located above the guide flange, the diameter of the guide ribs at their widest point slightly less than the diameter of the upper interior portion of the cap so that when the cap is in a fully closed position, there is a snug, non-interference fit between the cap and the nozzle.

7. The package of claim 5 wherein the nozzle further comprises a plurality of guide ribs equidistantly spaced around the nozzle, parallel to the axis of the package and located above the guide flange, the diameter of the guide ribs at their widest point slightly less than the diameter of the upper interior portion of the cap so that when the cap is placed in the fully closed position, there is a snug, noninterference fit between the cap and the nozzle.

8. The package of claim 1 wherein the chamber comprises dual walls.

9. A package, for storing and dispensing liquids, of the type in which a body comprising a nozzle with an orifice, and a chamber having a top surface from which the nozzle extends, has a cap which fits snugly over the nozzle, the cap also having an interior pin which fits into the orifice of the nozzle, keeping the nozzle from clogging, the improvement being a closure mechanism comprising:

(a) a pair of guide flanges equidistantly spaced on opposite sides of the nozzle, each flange further comprising a horizontal lock member and a vertical guide member, the vertical guide member perpendicular to the horizontal lock member, each vertical guide member having a lower raised ramp member, a guide surface defined by the raised ramp member and an adjoining face of the vertical guide member, and a stop surface defined by an opposite face of the vertical guide member;

(b) the cap having a lower portion with a first recess and an upper portion with a second recess, the first recess having a larger diameter than the second recess;

(c) a pair of stopping members in the lower portion of an interior of the cap, the stopping members extending throughout the lower portion of the cap, parallel to an axis of the body, each stopping member further comprising a parallel vertical edge which extends along the entire length of the stopping member, the stopping members located in a configuration such that when the cap is placed in a fully closed position on the body the two vertical edges abut the two stop surfaces of both of the vertical guide members, the abutment preventing the cap from over rotating on the body; and (d) a pair of equidistantly spaced band members in the lower portion of the cap, parallel to the axis of the body, each band member further comprising a slot which divides the band member into an upper portion and a lower portion, the slot located at about the same height as the horizontal lock member when the cap is placed in the fully closed position on the body and the slot having a width slightly larger than the width of the horizontal members of the guide flanges such that when the cap is placed in the fully closed position, the horizontal lock members extend through the slots, the lower portion of the band members extending from an end of the slot to a bottom of the cap;

such that to open the package, the cap is twisted about the axis of the package, retracting the horizontal locking members from the slots, until the lower portion of the band members touch and travel up the ramp members and the guide surfaces of the vertical guide members, disengaging the pin from the orifice and causing the removal of the cap from the body.

10. The package of claim 9 wherein the lower portion of the cap and the top surface of the chamber have an elliptical cross section with a major and minor axis, the guide flanges located on opposite sides of the minor axis, the stopping members located on opposite sides of the major axis just above and below the major axis, such that when the cap is placed in a fully closed position on the body, the vertical edges abut the stop surface of the vertical guide members, and the band members are located on opposite sides of the major axis.

11. The package of claim 9 wherein the package contains a curable material.

12. The package of claim 11 wherein the curable material is an adhesive.

13. The package of claim 9 wherein the closure mechanism further comprises two equidistantly spaced retaining nibs on opposite sides of the top surface of the chamber and two corresponding hollows in a base of the cap, such that when the cap is placed in a fully closed position on the body, the hollows engage the retaining nibs.

14. The package of claim 9 wherein the nozzle further comprises a plurality of guide ribs equidistantly spaced around the nozzle, parallel to the axis of the package and located above the guide flange, the diameter of the guide ribs at their widest point slightly less than the diameter of the upper interior portion of the cap so that when the cap is in the fully closed position, there is a snug, non-interference fit between the cap and the nozzle.

15. The package of claim 13 wherein the nozzle further comprises a plurality of guide ribs equidistantly spaced around the nozzle, parallel to the axis of the package and located above the guide flanges, the diameter of the guide ribs at their widest point slightly less than the diameter of the upper interior portion of the cap so that when the cap is in a fully closed position, there is a snug non-interference fit between the cap and the nozzle.

16. The package of claim 9 wherein the chamber comprises dual walls.

17. An improved package, for storing and dispensing liquids of the type in which a body comprising a nozzle with an orifice and a chamber, has a cap which fits snugly over the nozzle, the cap also having an interior pin which fits into the orifice of the nozzle keeping the nozzle from clogging, the improvement being a plurality of guide ribs equidistantly spaced around the upper portion of the nozzle, parallel to the axis of the package.

18. The package of claim 17 wherein there are four equidistantly spaced guide ribs.

19. The package of claim 1 wherein the package contains a hardenable material.

20. The package of claim 9 wherein the package contains a hardenable material.

* * * * *